US007266982B1

(12) United States Patent
Guza

(10) Patent No.: US 7,266,982 B1
(45) Date of Patent: Sep. 11, 2007

(54) HYDROFORMING DEVICE AND METHOD

(76) Inventor: David E. Guza, 374 Nathan Dr., Powell, OH (US) 43065

( * ) Notice: Subject to any disclaimer, the term of this patent is extended or adjusted under 35 U.S.C. 154(b) by 0 days.

(21) Appl. No.: 11/423,544

(22) Filed: Jun. 12, 2006

Related U.S. Application Data

(60) Provisional application No. 60/689,190, filed on Jun. 10, 2005.

(51) Int. Cl.
*B21D 9/15* (2006.01)
*B21D 39/08* (2006.01)

(52) U.S. Cl. ..... 72/60; 72/57; 29/421.1

(58) Field of Classification Search ..... 72/56, 72/57, 58, 60, 61, 62; 29/421.1
See application file for complete search history.

(56) References Cited

U.S. PATENT DOCUMENTS

| | | | | | |
|---|---|---|---|---|---|
| 3,572,073 | A | | 3/1971 | Dean | |
| 3,631,701 | A | * | 1/1972 | Hertel et al. | 72/56 |
| 3,643,482 | A | * | 2/1972 | Hertel et al. | 72/56 |
| 4,314,468 | A | * | 2/1982 | Baril et al. | 72/57 |
| 5,214,948 | A | | 6/1993 | Sanders | |
| 5,471,857 | A | * | 12/1995 | Dickerson | 72/57 |
| 5,481,892 | A | * | 1/1996 | Roper et al. | 72/61 |
| 5,890,387 | A | * | 4/1999 | Roper et al. | 72/58 |
| 5,974,847 | A | | 11/1999 | Saunders | |
| 5,992,197 | A | | 11/1999 | Freeman | |
| 6,029,487 | A | * | 2/2000 | Genin et al. | 72/58 |
| 6,067,831 | A | | 5/2000 | Amborn | |
| 6,253,588 | B1 | | 7/2001 | Rashid | |
| 6,322,645 | B1 | | 11/2001 | Dykstra | |
| 6,349,583 | B1 | | 2/2002 | Kleinschmidt | |
| 6,477,774 | B1 | | 11/2002 | Marando | |
| 6,532,784 | B1 | | 3/2003 | Dunn | |
| 6,613,164 | B2 | | 9/2003 | Dykstra | |
| 6,698,076 | B2 | | 3/2004 | Brissette | |
| 6,701,764 | B2 | | 3/2004 | Bruck | |
| 6,810,709 | B2 | | 11/2004 | Hammar | |
| 7,024,897 | B2 | | 4/2006 | Pfaffmann | |
| 2003/0181340 | A1 | | 9/2003 | Botz | |

* cited by examiner

*Primary Examiner*—David B Jones
(74) *Attorney, Agent, or Firm*—Standley Law Group LLP; James L. Kwak; Stephen L. Grant

(57) ABSTRACT

An apparatus (10, 110) and method to form a workpiece (32, 132) into a useful product (28, 128) using a pressurized fluid (14), also termed as "hydroforming". The workpiece may be a tube or may be one or a plurality of sheets of a material. The apparatus has a chamber (12) adapted to contain a quantity of a fluid, a hydroforming means positioned within the chamber, and means for substantially immersing the workpiece in the fluid before, during and after the hydroforming operation. Dies (16, 18) enclose the workpiece and provide a cavity of desired shape against which the workpiece is expanded by the pressurized fluid. The chamber may be open or closed to the atmosphere during operation and the fluid temperature and/or level may be controlled.

23 Claims, 12 Drawing Sheets

HYDROFORMING DEVICE AND METHOD

CROSS-REFERENCE TO RELATED APPLICATIONS

This application is a nonprovisional application of, and claims priority from, U.S. provisional application Ser. No. 60/689,190, filed 10 Jun. 2005, which is incorporated by reference as if fully recited herein.

GOVERNMENT LICENSE RIGHTS

The U.S. Government has a paid-up license in this invention and the right in limited circumstances to require the patent owner to license others on reasonable terms as provided by the terms of STTR Grant No. DE-FG-02ER86141 awarded by the U.S. Department of Energy.

TECHNICAL FIELD

The present invention relates to a method of high pressure forming of materials. More particularly, the embodiments disclosed relate to a method and device for hydroforming in which an immersion bath of fluid, preferably the hydroforming fluid, is used to control the temperature of the workpiece at least before and during the hydroforming process.

BACKGROUND OF THE ART

Historically, metal forming has involved forging, stamping, drawing, welding, and bending processes, just to name a few for illustrative purposes. In recent years, hydroforming has been shown to be useful in imparting complex shapes to a metal blank, whether tubular or sheet. In a typical hydroforming operation, a workpiece blank is cut and preformed into the approximate shape of the finished product, if the shape is conducive to the preforming step. The blank is then placed in a cavity formed within a typical two-part split die. A hydraulic press closes the die and applies a die-closing pressure, the amount of which is determined in part by the component geometry and the forming parameters.

If the blank is tubular, the ends thereof are sealed by means of hydraulic rams and the tube interior is filled with a fluid, usually an incompressible fluid, and typically a water and oil mixture. Increasing the fluid pressure in the blank causes it to yield and plastically conform its outer surface expansively into the shape of the interior surface of the die cavity. This plastic expansion displaces the gas initially present in the cavity space between the blank and the die. Because the fluid is usually incompressible, the increased pressure is usually achieved by feeding additional fluid into the blank. Once the piece is conformed to the shape of the die cavity, the tube ends are unsealed, the forming fluid is depressurized and drained, and the press and die opened to remove the formed component.

If the blank is a sheet, a periphery of the sheet may be sealed between die halves by the hydraulic press and a space between one half of the die and the sheet may be pressurized with the fluid. Increasing the fluid pressure in the blank causes it to yield and plastically conform its outer surface expansively into the shape of the interior surface of the other die half cavity. This plastic expansion displaces the gas initially present in the cavity space between the sheet and that other die half. Because the fluid is usually incompressible, the increased pressure is usually achieved by feeding additional fluid into the space. Once the piece is conformed to the shape of the die cavity, the forming fluid is depressurized and drained, and the press and die opened to remove the formed component.

In some circumstances, the blank can be a pair of sheets, with a small spacing left between them when they are registered in the press. A periphery of the registered sheets may be sealed against each other or an interstitial sealing surface by the hydraulic press. The space between sheets may then be pressurized with the fluid. Increasing the fluid pressure in the blank causes each of the sheets to yield and plastically conform its outer surface expansively into the shape of the interior surface of its respective die cavity. This plastic expansion displaces the gas initially present in the cavity spaces between the respective sheets and facing die halves. Because the fluid is usually incompressible, the increased pressure is usually achieved by feeding additional fluid into the spacing. Once the sheets are conformed to the shape of the die cavity, the forming fluid is depressurized and drained and the press opened to remove the formed component sheets.

Much of the prior attention in hydroforming technology has been directed at steel and other ferrous alloys. However, the automotive industry's interest in improving fuel efficiency by reducing vehicle weight has caused a desire to shift in the materials selected for automobile fabrication from plain carbon steels, to higher strength-to-weight materials such as high strength steels and some high-performance polymers. Lightweight aluminum alloys are also being implemented increasingly into vehicle structural components. In the future, even higher strength-to-weight materials, such as magnesium, will become attractive if the formability of these materials can be improved.

Unfortunately, lightweight materials, such as aluminum and magnesium, typically exhibit relatively low formability at room temperatures, although their formability at higher temperatures is quite acceptable. These materials also typically exhibit sensitivity during forming to strain-rates, a sensitivity that is further affected by temperature. For these reasons, the rate of forming and forming temperature of the workpiece must be controlled. Temperature gradients in the workpiece, while desirable in some situations, may complicate the forming process. When hydroforming is conducted at temperatures significantly different from ambient, contact of the workpiece with air or with solid surfaces that are at ambient temperatures may result in uneven heating or cooling of the workpiece, even during the hydroforming operation.

To form materials at elevated temperatures, a workpiece blank must be preheated to the proper forming temperature to enhance formability. The temperature distribution within the part can have significant effect on the finished part quality since an uneven temperature distribution will correspondingly produce uneven levels of formability, which can produce an undesirable wall-thinning distribution within the part. Consequently, it is generally desirable to maintain a uniform temperature distribution during part forming. Attempts have been made to use a gas as a pressurizing fluid medium to hydroform a part, but one major drawback in using a gas lies in its compressibility as well as sensitivity to volumetric change imparted by temperature change making pressure and volume control of the fluid difficult during the forming process. To control material strain-rate, an incompressible fluid is ideally suited to allow precise volume control of the pressurizing medium during the forming process. As compared to a gas, a liquid can be considered to be essentially incompressible and provides a superior medium by which to hydroform parts. If parts are to be formed using a liquid medium, that medium should preferentially, for example, be capable of working in the part forming temperature range without boiling, be resistant to excessive oxidation, and be nonflammable. Consequently, new methods are needed to hydroform materials at elevated temperatures using liquid media. Additionally, current hydroforming processes operating at ambient temperatures that use liquid media require pumping systems and fluid plumbing loops to fill and empty the workpiece or forming apparatus before and after the forming process. Another disadvantage of current hydroforming methods requires a separate step of applying lubricants to the workpiece before hydroforming.

It is, therefore, an advantage of the present invention to provide a hydroforming device and method where the temperature of the workpiece is controlled in an immersion bath of fluid, preferably the hydroforming fluid, at least before and during the hydroforming process. Another advantage of the present invention is appreciated by providing a more effective and efficient method of introducing and removing the pressurizing liquid medium to and from a workpiece during a hydroforming operation. Yet another advantage of the present invention is appreciated by providing a more effective and efficient method of introducing lubricants to a workpiece. Further advantages of the present invention will be described subsequently in more detail herein.

SUMMARY OF THE INVENTION

These and other advantages are provided by the exemplary embodiments of the present invention.

In an exemplary embodiment, an apparatus for hydroforming a workpiece into a product comprises a chamber adapted for containing a quantity of an incompressible fluid and a means for hydroforming the workpiece, the means being situated in the chamber such that a workpiece is substantially immersed in the incompressible fluid during the hydroforming operation thereupon.

In one embodiment, the workpiece is a tube having open ends and the hydroforming means comprises first and second dies, a means for sealing the open tube ends, and a means for injecting and pressurizing a fluid suitable for hydroforming into a cavity in the tube, wherein the injecting and pressurizing means are communicated to the sealing means. Many of these embodiments will further comprise at least one means for venting the incompressible fluid residing between the tube and the respective first and second dies as the tube expands against the dies.

In another exemplary embodiment, the workpiece is a sheet and the hydroforming means comprises a first die. The apparatus will also comprise a means for sealing a periphery of the sheet in the hydroforming means with a first side of the sheet facing the first die and a means for injecting and pressurizing a fluid suitable for hydroforming into a sealed cavity on a second side of the sheet. Many of these embodiments will comprise at least one means for venting the incompressible fluid residing between the first side of the sheet and the first die as the sheet expands against the die.

In a yet further embodiment, the workpiece is a pair of sheets with a first sheet and second sheet and the hydroforming means comprises a first and a second die, with the pair of sheets registrable between the dies wherein the apparatus will also comprise a means for sealing a periphery of the sheets in the hydroforming means with a first side of the first sheet facing the first die and first side of the second sheet facing the second die and a means for injecting and pressurizing a fluid suitable for hydroforming into the space extant interstitially between the second sides of the sheets. This embodiment of the present invention allows for the hydroforming of two product parts simultaneously. It should be noted that many of these embodiments described herein will comprise at least one means for venting the incompressible fluid residing between the first side of the sheet or tube and the die cavity as the sheet or tube expands towards the die.

In any of the above embodiments, the chamber may be adapted to be either opened or closed to the atmosphere, at least during the hydroforming operation.

In any of the above embodiments, the apparatus may further comprise means for maintaining the fluid at a controlled temperature, especially in embodiments where the controlled temperature differs from ambient by more than 20 degrees Fahrenheit. Such fluid temperature control may be achieved, for example, by heaters, coolers, and/or heat exchangers internal, external or both to the chamber. Furthermore, means for maintaining a substantially uniform temperature distribution within the fluid may comprise fluid agitation or circulation.

In any of the above embodiments, the apparatus may also comprise means for raising or lowering a fluid level in the chamber in association with engagement or disengagement of the hydroforming means with the workpiece, or alternatively, not in association engagement or disengagement of the hydroforming means with the workpiece as achieved by a separate fluid level control means.

Other advantages of the invention are realized through the practice of a process described in an exemplary manner below. An exemplary process hydroforms a workpiece into a product by moving the workpiece into a cavity of a die, the die and workpiece positioned and substantially immersed in a bath of an incompressible fluid, closing the die upon workpiece and maintaining a pressure thereupon, expanding the workpiece plastically in the die to fill the cavity by injecting a pressurized incompressible fluid into an interior (in the case of a tube) or upon a preferred surface (in the case of a sheet) thereof, thereby forming the product, and opening the die and removing the product therefrom.

In any of the above embodiments, the apparatus may comprise a portion of the chamber that is reserved for temporarily storing and pre-soaking at least one and preferably a plurality of workpieces in the fluid and means for transferring the workpieces individually into the hydroforming means.

In some of these exemplary processes, the process further comprises the step of pre-soaking the workpiece in the bath maintained at a controlled temperature prior to the step of moving the workpiece into the die.

In some of these exemplary processes, the process may advantageously benefit from operation at ambient temperatures as a result of efficient employment of the fluid to quickly pre-fill a workpiece blank before the hydroforming operation, for example in the case of a tube hydroforming operation, as well as effective containment of the fluid during and after the hydroforming operation.

In some of the exemplary processes, the step of closing the die further comprises the step of raising a level of the fluid to immerse the workpiece in the fluid; and the step of opening the die further comprises the step of lowering the fluid level to expose the product.

In some of the exemplary processes, the process comprises the further steps of closing a chamber containing the bath prior to moving the workpiece into the cavity; and opening the chamber after removing the product from the die.

In some of the exemplary processes, the fluid is maintained at a temperature at least 20 degrees Fahrenheit different from an ambient temperature.

In some of the exemplary processes, the pressurized fluid injected into the interior of the workpiece (in the case of a tube) or upon a preferred surface (in the case of a sheet) thereof, comprises a portion of the incompressible fluid in the bath.

In some of the exemplary processes, the pressurized fluid used to hydroform a workpiece embodies a lubricant or lubricants to facilitate hydroforming a workpiece.

BRIEF DESCRIPTION OF THE DRAWINGS

Other aspects of the present invention will be readily apparent from the following descriptions of the drawings and exemplary embodiments, wherein identical reference numerals refer to identical parts, and wherein.

DETAILED DESCRIPTION OF A PREFERRED EMBODIMENT

Figure 2:
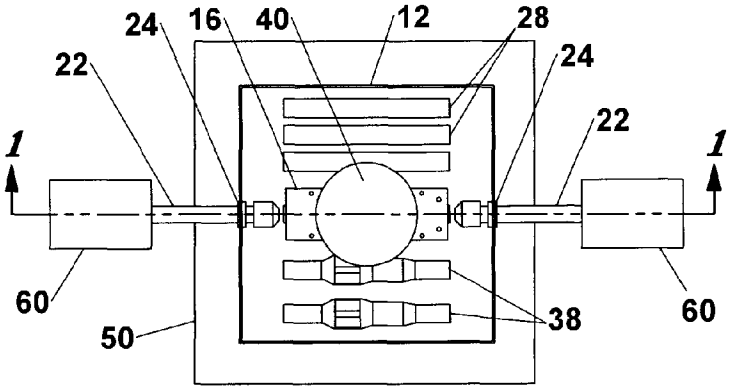
FIG. 2 is a top plan view of the FIG. 1 embodiment.
Figure 1:
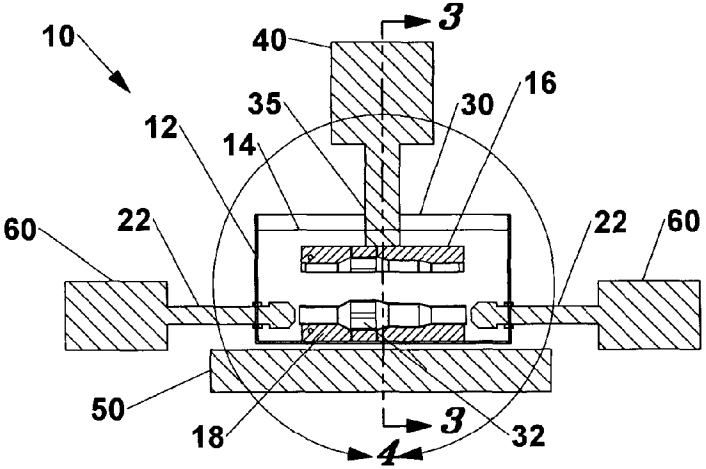
FIG. 1 is a front sectional elevation view of an embodiment of the invention illustrating a tube hydroforming application.
Figure 3:
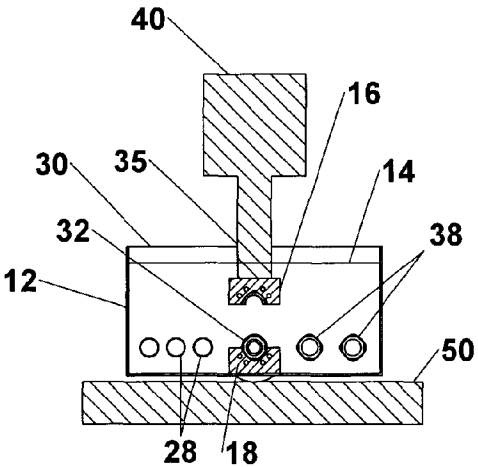
FIG. 3 is a side sectional elevation view of the FIG. 1 embodiment.

Referring first to FIGS. 1, 2, and 3, a hydroforming apparatus 10, which is shown for use in a tubular forming application, comprises a chamber 12 and a means for hydroforming that is positioned in the chamber such that a tubular blank 28 may be substantially immersed in a fluid 14 and subsequently formed as a workpiece 32 during the hydroforming operation. The fluid 14 may be used as a temperature control medium, a pressurization medium, and a lubrication medium and is preferably one with a characteristically wide operating temperature range that resists oxidation and has a high ambient pressure boiling point. One example of the fluid is DYNALENE HTF-600, commercially available from Dynalene Heat Transfer Fluids of Whitehall, Pa. DYNALENE HTF-600 is a silicone-based liquid that has a suggested range of use from 150° to 550° Fahrenheit. Extant or future developed fluids of similar or different composition having or exceeding these performance characteristics may be used. To fulfill the pressurization function, a preferred fluid will be essentially incompressible. It will also be preferably a single phase liquid, although a liquid that has a micellar composition of two liquid phases is also useful. The fluid is preferably used in a heat transfer regime that does not involve phase change, that is, it is not desired for any substantial amount of boiling or condensation to occur at the fluid/workpiece interface, particularly any boiling that would result in a gas film at the interface that would inhibit heat transfer.

Figure 7:
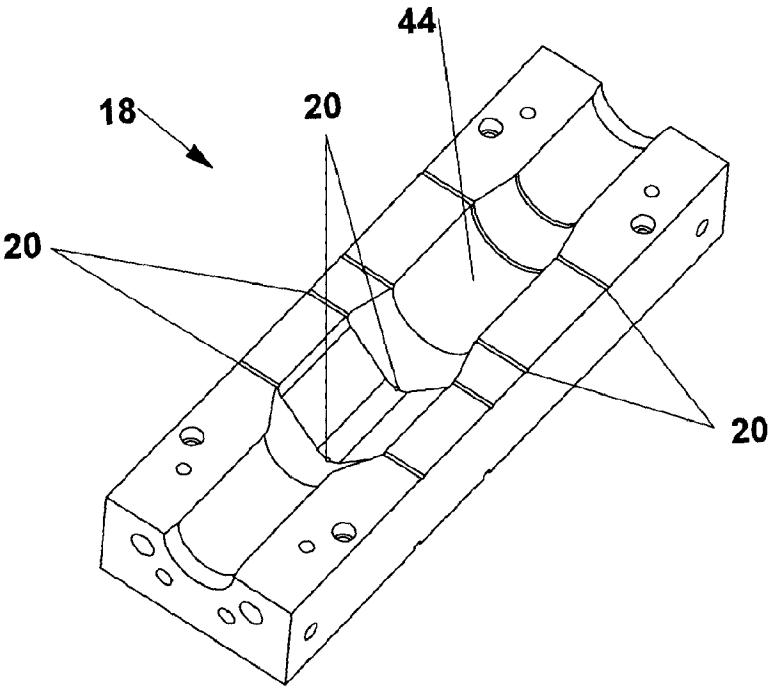
FIG. 7 is a perspective view of one example of a die half used in the FIG. 1 embodiment.

Referring still to FIGS. 1, 2, and 3, the chamber 12 may be either open to the ambient atmosphere or sealed from the ambient atmosphere by means of a chamber closure 30. The hydroforming means illustrated in FIG. 1 comprises, for example, a set of forming dies with an upper die 16 and a lower die 18, which are used to impart the desired final shape onto the workpiece 32, wherein each die has a cavity feature which embodies the shape of the desired product. As further exemplified in FIGS. 4 and 7, dies 16 and 18, located within chamber 12, are vented by fluid vent ports 20 which allow fluid 14, captured within die cavity 44 between the workpiece 32 and the die set, to freely exit to the chamber 12 so as to not restrict part expansion during part forming. The hydroforming means, as shown in more detail by FIG. 4, furthermore typically embodies docking rods 22 which further comprise sealing tips or punches 26 that are used to seal the ends of a workpiece 32 during the forming process. The docking rods 22, shown in FIGS. 1, 2 and 4, penetrate the walls of chamber 12 and communicate axial forces from actuators 60 typically external to chamber 12, to workpiece 32 via the punches 26 to seal the workpiece 32 and provide end feeding of material within the workpiece 32 during the forming operation. The docking rods 22 may be inserted and retracted through the tank walls via fluid seals 24, which may embody sliding o-ring type seals, mechanical flexible bellows, or by other means known in the art, which allow docking rod axial movement within the dies 16 and 18 without leakage of fluid 14 from the chamber 12. Fluid 14 may be introduced into and pressurized within workpiece 32 via fluid ports (not shown) located within the docking rods 22 and sealing tips 26. Pressurization of fluid 14 during the hydroforming operation may be achieved by means of a fluid pressure intensifier or other means known in the art. Furthermore, if the hydroforming operation is accomplished for example at a temperature other than ambient, the injected volume of fluid 14 required to form workpiece 32, as introduced by the fluid pressurization means, may be brought to the desired temperature by means of a temperature controlling and heat exchanging means, as may be required for example, if the fluid pressurization means is operated at a temperature differing from the desired workpiece forming temperature, whereby the temperature controlling and heat exchanging means provides a means to thermally isolate the fluid pressurization means from that portion of the hydroforming means located within chamber 12 and prevents possible undesirable temperature fluctuations within workpiece 32 as a result of injecting that portion of fluid 14 required to form workpiece 32 that may otherwise be at a temperature that differs from the desired workpiece forming temperature. Die 16 may be raised or lowered within chamber 12 relative to die 18 by means of, for example, a press 40, whereby chamber 12 and die 18 are statically supported by press bed 50, thereby permitting closure of die 16 upon die 18 and providing the requisite resistive force to prevent the die set from parting during hydroforming operations. If chamber 12 is closed by means of chamber closure 30, the void formed within chamber 12 located above fluid 14 may be optionally filled with an inert gas such as, but not limited to, nitrogen or argon to minimize oxidation of fluid 14 by contact with the atmosphere. Press 40 and die 16 movement are permitted via chamber closure seal 35, which provides a fluid seal to mitigate loss of the inert gas and contact of fluid 14 with the atmosphere, as well as loss of fluid 14 otherwise due to evaporation. Chamber closure seal 35 may embody sliding o-ring type seals, mechanical flexible bellows, or by other sealing means known in the art, to allow press 40 and die 16 movements within chamber 12.

Referring to FIGS. 1 through 7, one preferred method of hydroforming using the advantages of this invention will be described. One or more tube blanks 28 are substantially submerged within fluid 14 that are contained within tank or chamber 12 so that fluid 14, maintained at a selected temperature that may range from above the freezing point to the boiling point of the fluid, may thermally condition and lubricate the sheet blanks 128. Control and maintenance of the fluid temperature may be achieved by any method known in the art which may be, for example, by external fluid heating/cooling devices or by electric means. For some materials, the desired forming temperature and fluid temperature will be at least twenty degrees Fahrenheit above ambient and is dependent upon the forming temperature of the material being hydroformed. Substantially immersing workpiece tubular blanks 28 in fluid 14 simultaneously fills the tubular blanks 28 rapidly with fluid 14 thereby advantageously displacing any undesirable compressible air captured within tubular blank 28, rapidly brings tubular blanks 28 to the desired forming temperature by direct fluid contact, and may apply beneficial lubrication to tubular blanks 28 as a result of embodying a lubricant or lubricants within fluid 14, thus performing otherwise separate serial operations practiced in the conventional hydroforming process significantly reducing processing time and consequent cost. It should furthermore be noted that this novel approach with its numerous resulting benefits may be applicable to hydroforming workpieces at ambient temperature as well as at temperatures that differ from ambient. Introducing tubular blanks 28 into the apparatus 10, and moving them around once introduced, may be done via a conveyor or robotic system known in the art. If the chamber 12 is closed to the atmosphere via chamber cover 30, tubular blanks 28 may be introduced via air-locks to minimize contact of fluid 14 with the atmosphere, thereby retarding possible oxidation and loss of fluid 14 by evaporation thereof. This may be particularly important when fluid 14 is maintained at a temperature significantly above ambient. One workpiece 32 is shown positioned within the die set 16 and 18 wherein the dies are subsequently closed and loaded, typically by means of a conventional hydraulic or similar type press 40, to prevent separation of the dies during the forming process. Subsequently, docking rods 22 position and force the sealing tips 26 into the ends of workpiece 32 to form a high-pressure seal. Fluid 14, already present in an interior cavity of the workpiece 32, is pressurized by injecting additional fluid by means of, for example, a fluid pressure intensifier which may be located external to chamber 12. This pressure and the temperature of the workpiece 32 encourages plastic expansion of the workpiece to conform with the die cavity 44, while the docking rods 22 and sealing tips 26 advance inward to assist material movement during the process as required. When the forming process is completed, the die set 16 and 18 is opened and the hydroformed product 38 is removed from the hydroforming means for subsequent processing. Typically, this involves removal of the hydroformed product 38 from the chamber 12 as soon as possible after forming, although it may involve moving the formed product to a position in the chamber 12 where it is no longer in intimate contact with fluid 14.

Figure 6:
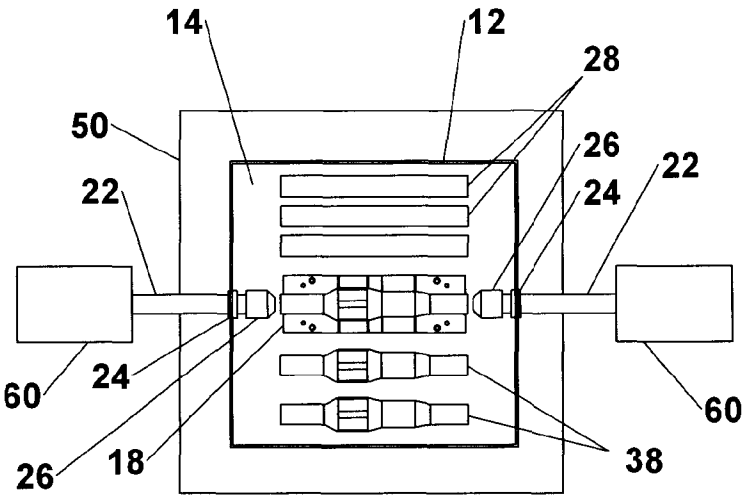
FIG. 6 is a top plan view illustrating the FIG. 1 embodiment with the upper die and press removed for clarity.
Figure 5:
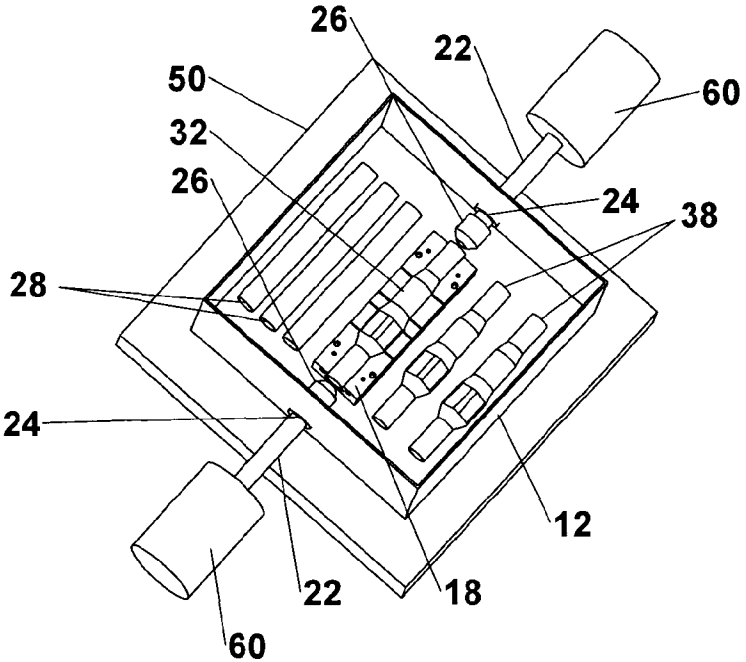
FIG. 5 is a perspective view of the FIG. 1 embodiment, with the upper die and press removed for clarity.

FIGS. 5 and 6 illustrate one configuration of a preferred embodiment wherein chamber 12 embodies pre-forming, forming, and post-forming locations as a hydroformed product is produced. As illustrated, a reservoir area adjacent to die 18 may hold one or a plurality of tubular blanks 28 in a submerged condition within fluid 14 to allow pre-filling of the blank with fluid 14 and allow thermal soaking to promote temperature equilibration of the pre-formed blank. The temperature equilibrated tubular blank 28 is then moved to the forming location as defined by die 18, whereupon the workpiece 32 is formed into hydroformed products 38, which are subsequently moved out of die 18 to the post-forming location, as illustrated, and thereafter removed from chamber 12 allowing recovery of fluid 14 drained from hydroformed products 38.

It should be particularly noted that the insertion of the tubular blank 28 into fluid 14 within chamber 12 effectively fills the tubular blank 28 with fluid 14 and subsequent removal of the hydroformed product 38 from fluid 14 within chamber 12 drains fluid 14 from the hydroformed product 38 back into the fluid reservoir as defined by chamber 12, eliminate the need for external fluid plumbing and conditioning loops and pumping systems required by convention hydroforming methods needed to handle fluid transfer into and out of a workpiece, which consequently reduces process cost and time. Furthermore, an additional advantage of using fluid 14 as the pressurizing medium is that a significantly smaller volume of fluid need be introduced into a workpiece to form a product, since only that portion of the fluid 14 needed to form the workpiece 32 is required, as compared to the a larger volume typically required to both fill and form and drain the workpiece.

Methods of agitating the fluid via displacement, circulating pumps, or mechanical agitators known in the art, may be employed to maintain an even temperature distribution with the body of the fluid to insure uniform heating of the part. Additionally, dies 16, 18 may be heated by direct contact with the fluid 14 or supplementally heated with auxiliary heating methods such as circulating fluid or electric heating methods. In the case of fluid heated dies, fluid 14 may optionally be used as the heat transfer fluid. Alternatively, fluid 14 may be heated by direct contact with one or both dies 16 or 18 that may be heated by another means.

If chamber 12 is closed to the atmosphere, tubular blanks 28 may be introduced and the hydroformed product 38 removed from chamber 12 via air-locks. Additionally, exposed fluid surfaces may optionally be blanketed with inert gases to minimize fluid contact with the atmosphere to retard oxidation of the fluid 14. Additionally, the level of fluid 14 may be at any level within chamber 12 conducive to the forming operation which may indicate continuous submersion of both dies 16 and 18 within the fluid 14 or intermittent submersion of one die or both dies 16 and 18. If chamber 12 is open to the atmosphere, the upper die 16 may be alternatively immersed and removed from fluid 14 as determined by the desired level of fluid 14 during each forming operation. Chamber 12 may be thermally insulated to reduce undesirable heat transfer with the environment.

Figure 4:
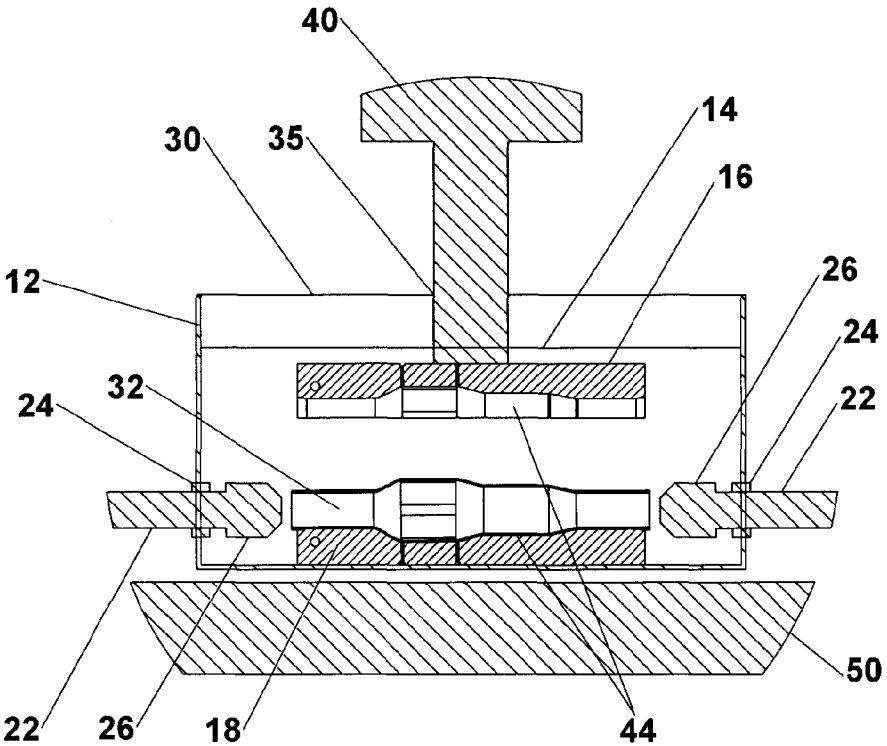
FIG. 4 is an enlarged sectional view of FIG. 1.
Figure 9:
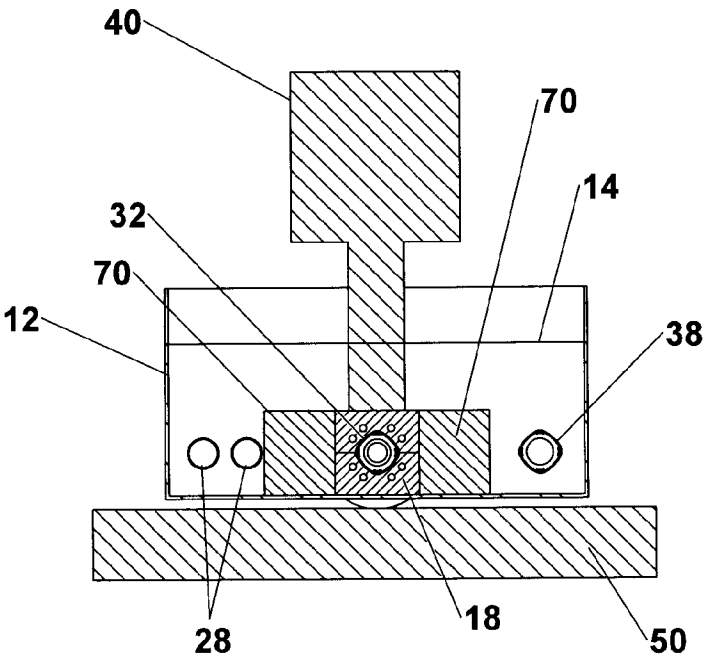
FIGS. 8 and 9 show, in side sectional elevation view, the fluid level change induced by movement of fluid-displacing members before and after hydroforming.
Figure 8:
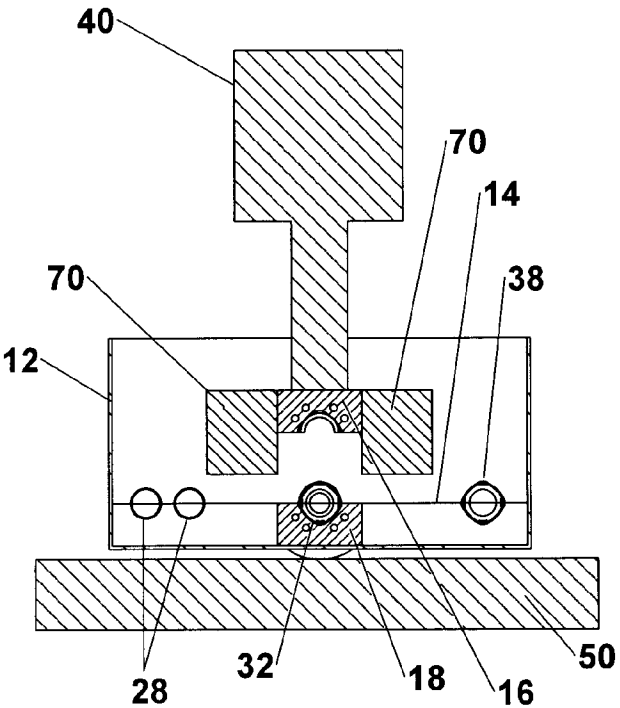
Figure 10:
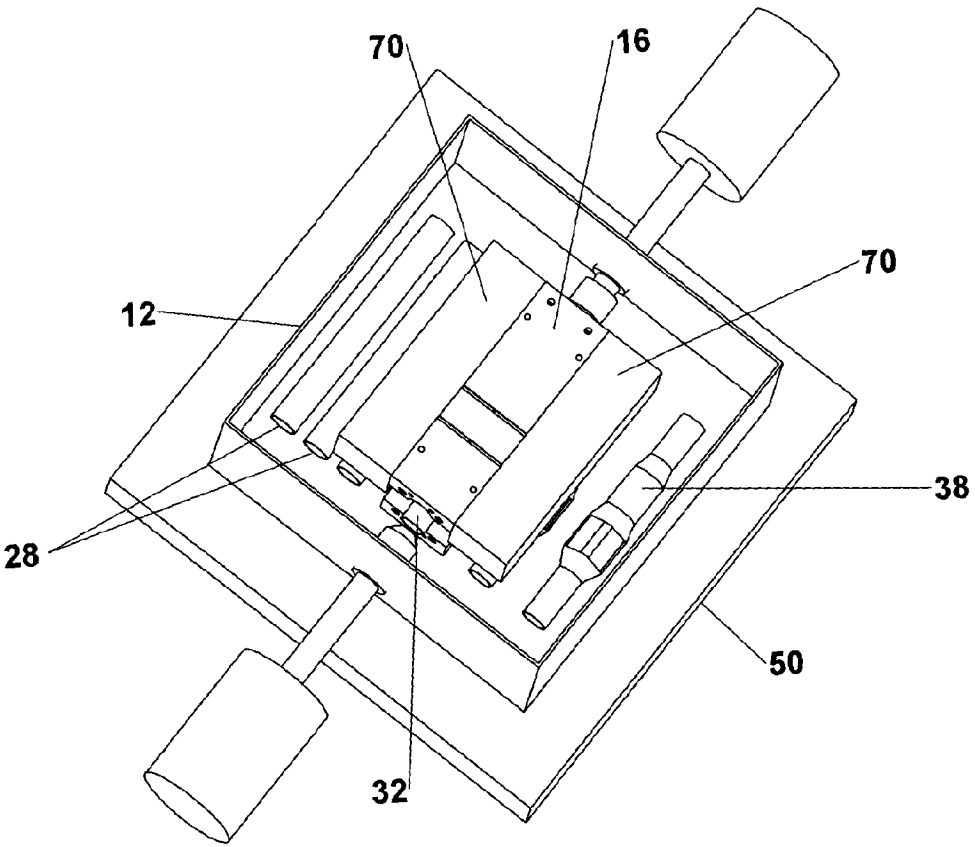
FIG. 10 is a perspective view of the FIG. 1 embodiment with the upper die and press removed for clarity in showing fluid displacing members.
Figure 12:
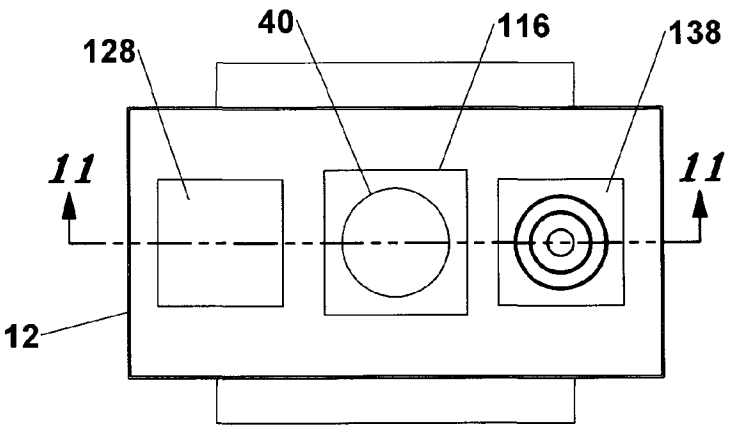
FIG. 12 is a top plan view of the FIG. 11 embodiment.
Figure 11:
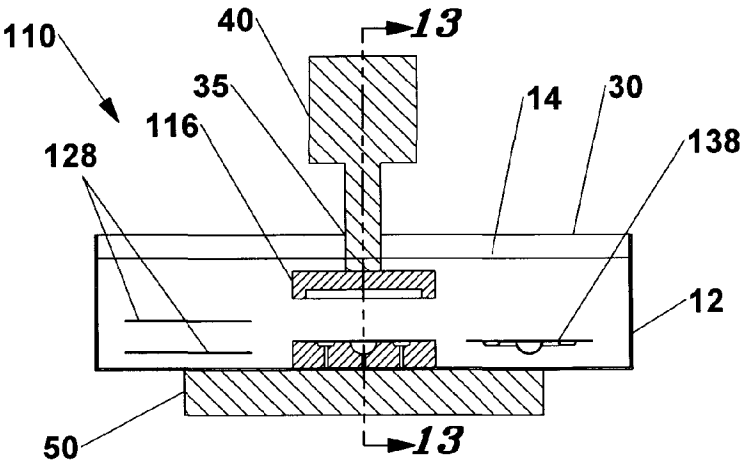
FIG. 11 is a front sectional elevation view of a second embodiment of the invention illustrating a sheet hydroforming application.
Figure 13:
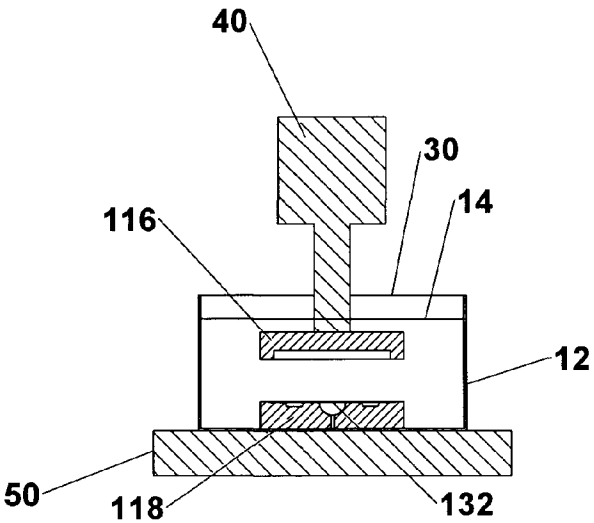
FIG. 13 is a side sectional elevation view of FIG. 11 embodiment.
Figure 14:
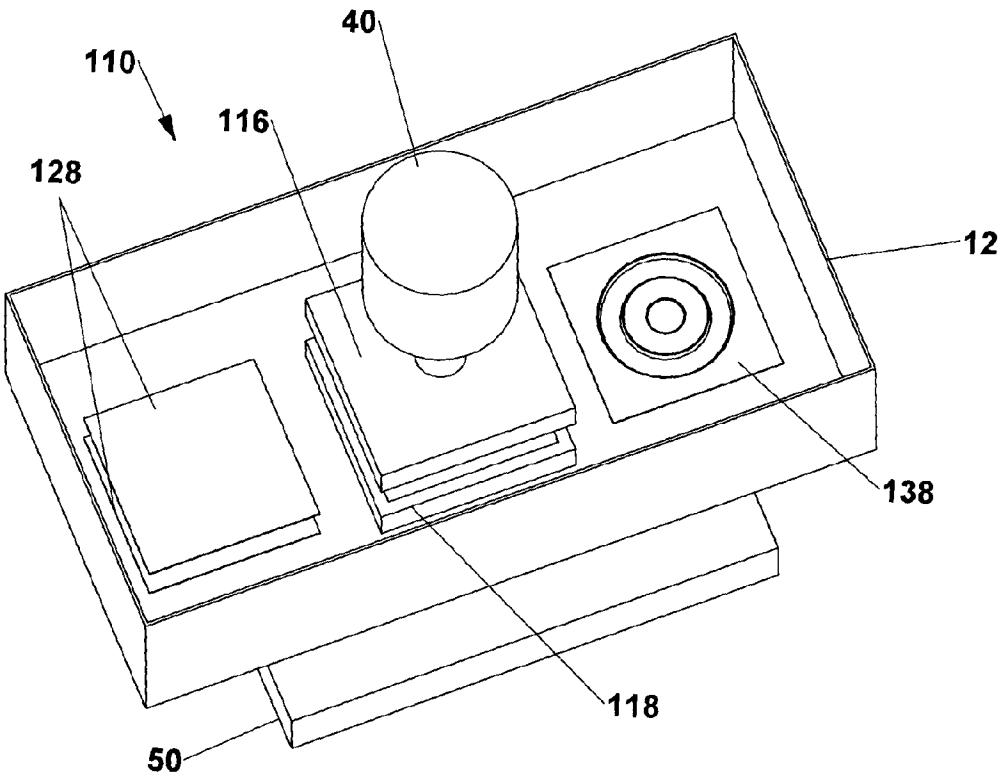
FIG. 14 is a perspective view of FIG. 11 embodiment.
Figure 15:
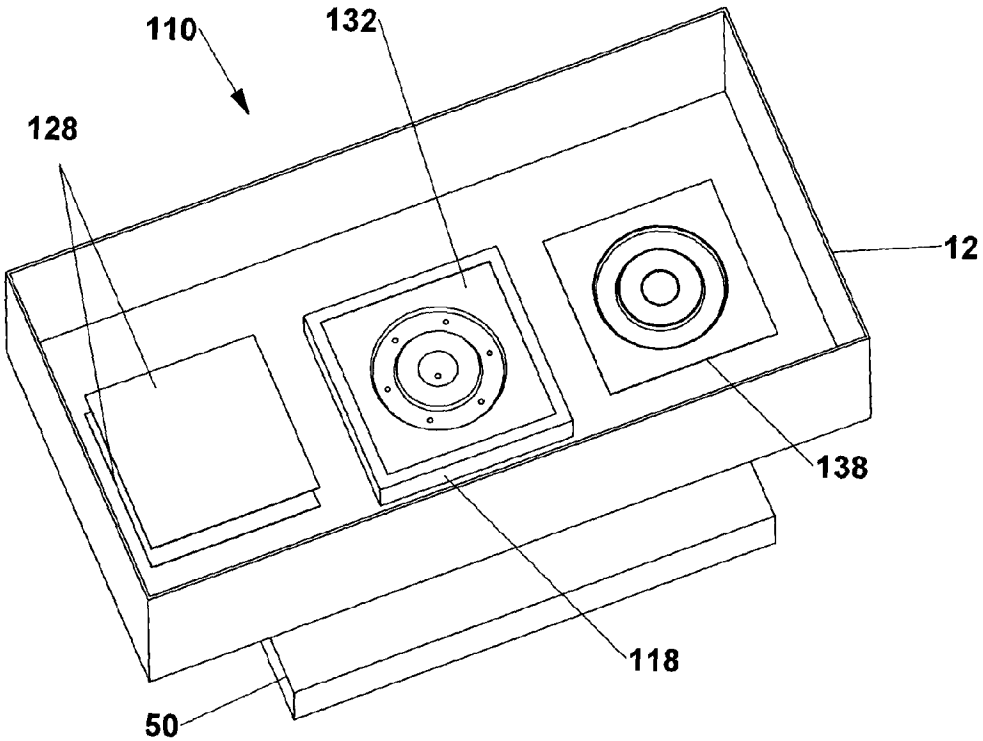
FIG. 15 is a perspective view of FIG. 11 embodiment with the upper die and press removed for clarity.

Referring to FIGS. 1, 3, and 4, the level of fluid 14 within chamber 12 may be static or may be controlled by displacement or pumping methods known in the art. In at least some embodiments, the movement of the press 40 and upper die 16 into place for forming operations may be used to increase fluid 14 height and removal of the upper die may be used to lower fluid height. This may be achieved by a variety of means, but one method as further shown, for example, in FIGS. 8, 9, and 10, is to have at least one fluid-displacing member 70 attached to the upper die 16, or press 40, so that the movement of the die 16 or press 40 within chamber 12 moves the fluid-displacing member(s) 70 into and out of fluid 14 thereby changing the level of fluid 14. Such fluid level changes may advantageously be used to temporarily expose the product from the fluid 14 during forming operations, if required.

Figure 16:
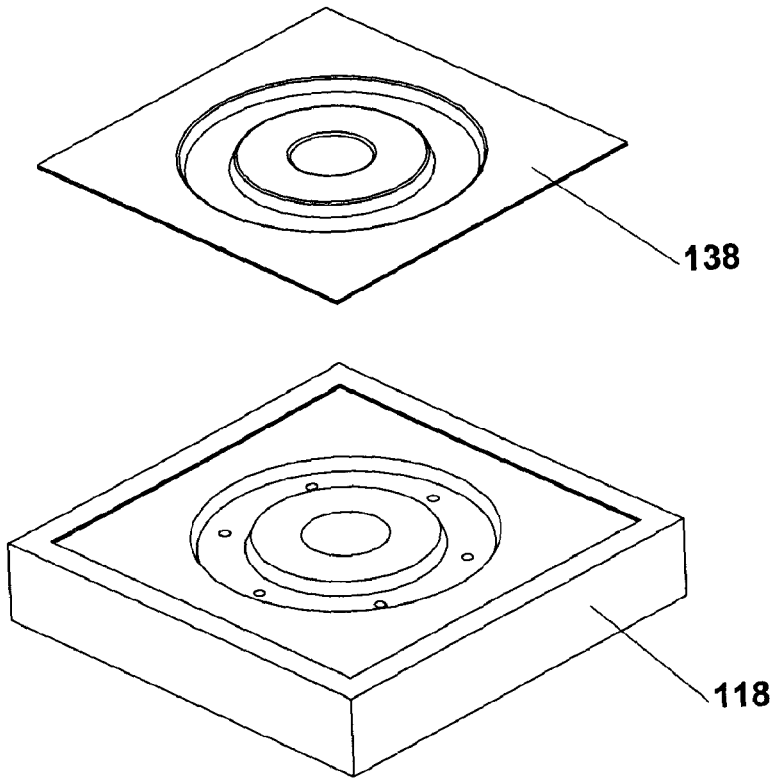
FIG. 16 is a perspective view of an embodiment of the invention illustrating a die and formed sheet as produced from a sheet hydroforming application.
Figure 17:
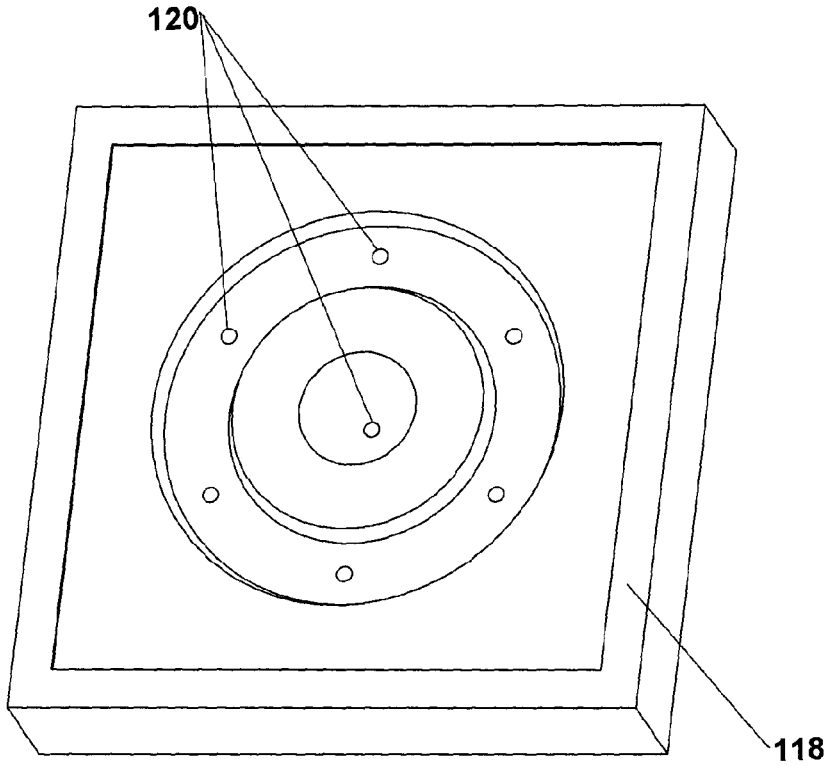
FIG. 17 is an enlarged perspective view of the die of FIG. 16, further illustrating fluid vents.

FIGS. 11 through 15 illustrate a further embodiment of the hydroforming apparatus 110, as similarly applied to a sheet forming operation. As will be described below, with the exception that a sheet material and requisite differences in hydroforming means are used in place of a tube material and related tube hydroforming means, many of the embodiments, features, and benefits of this invention as described above in a tube hydroforming application, are applicable to sheet hydroforming. One or more sheet blanks 128 are substantially submerged within fluid 14 that are contained within tank or chamber 12 so that fluid 14, maintained at a selected temperature that may range from above the freezing point to the boiling point of the fluid, may thermally condition and lubricate the sheet blanks 128. Control and maintenance of the fluid temperature may be achieved by any method known in the art which may be, for example, by external fluid heating/cooling devices or by electric means. For some materials, the desired forming temperature and fluid temperature will be at least twenty degrees Fahrenheit above ambient and is dependent upon the forming temperature of the material being hydroformed. Similar to the tube forming operation described herein, an upper die 116, press 40, and a lower die 118 are used to impart the desired overall shape to a sheet workpiece 132. However, in one method of sheet forming sometimes referred to in the art as a "one-sided die operation," one die, as depicted by lower die 118, contains the desired shape that is to be imparted upon a sheet blank 128, while the other die, as depicted by upper die 116, contains ports or cavities that allow fluid 14 access to the side of sheet workpiece 132 opposite to die 118. During part forming, pressurized fluid 14 is introduced between the upper die 116 and a positioned workpiece 132 through the ports in upper die 116 to conform the workpiece 132 to the shape of the lower die cavity 118. An example of a hydroformed sheet part 138, as formed by means of a one-sided operation, is further illustrated in FIG. 16. To allow fluid 14 trapped between the workpiece 132 and die 118 to freely exit to the chamber 12 so as not to restrict part expansion during part forming, the lower die 118 is vented with a venting port or ports 120, as further illustrated by example in FIG. 17.

FIGS. 11 through 17 also illustrate a method of hydroforming using a sheet forming operation. A potential workpiece, in this case, sheet blank 128 is introduced into chamber 12 of apparatus 110 and immersed in a fluid 14 that is maintained at the desired forming temperature of the part material, which may range from above the freezing point to the boiling point of the fluid. Immersion of a sheet blank 128 within fluid 14 simultaneously thermally conditions the workpiece 132 to the desired forming temperature and may apply lubrication to the sheet part blank or blanks 128 embodied within the characteristics of the fluid 14, thus performing otherwise separate serial operations practiced in the conventional hydroforming process and thereby significantly reducing workpiece 132 processing time. Introduction of the sheet blanks 128 into and through the apparatus 110 may be done via a conveyor or robotic system commonly used in the art. If the chamber 12 is closed to the atmosphere, the parts may be introduced via air-locks to minimize fluid contact with the atmosphere to retard oxidation of the fluid 14, as describe above. A positioned workpiece 132 is situated within the die set 116, 118 wherein the dies are subsequently closed and loaded, typically by means of a conventional hydraulic or similar type press 40, to prevent die separation during the forming process. Closing dies 116, 118 form a fluid seal against workpiece 132. Fluid 14 is pressurized through port or ports in die 116 by injecting additional fluid via a fluid pressure intensifier or similar pressurization means known in the art, causing plastic deformation of the workpiece 132 and forming it into a shape dictated by die 118. When the forming process is completed, the hydroformed sheet product 138 is removed from the die set 116, 118 and chamber 12 for subsequent processing.

Still referring to FIGS. 11 through 17, the level of fluid 14 within chamber 12 may be static or may be controlled by displacement or pumping methods known in the art. Furthermore, methods of agitating the fluid via displacement, circulating pumps, or mechanical agitators known in the art, may be employed to maintain an even temperature distribution with the body of the fluid to insure uniform heating of the part. Additionally, dies 116 and 118 may be heated by direct contact with the fluid 14 or supplementally heated with auxiliary heating methods such as circulating fluid or electric heating methods. In the case of fluid heated dies, fluid 14 may optionally be used as the heat transfer fluid. Alternatively, fluid 14 may be heated by direct contact with one or both dies 116 or 118 that may be heated by another means. If the chamber 12 is closed to the atmosphere, the parts may be introduced via air-locks and exposed fluid surfaces may optionally be blanketed with inert gases as described above to minimize fluid contact with the atmosphere to retard oxidation of the fluid 14. Additionally, the level of fluid 14 may be at any level within chamber 12 conducive to the forming operation which may indicate continuous submersion of both dies 116 and 118 within the fluid 14 or intermittent submersion of one die or both dies 116 and 118. If chamber 12 is open to the atmosphere, the upper die 116 may be alternatively immersed and removed from fluid 14 as determined by the desired level of fluid 14 during each forming operation.

Figure 18:
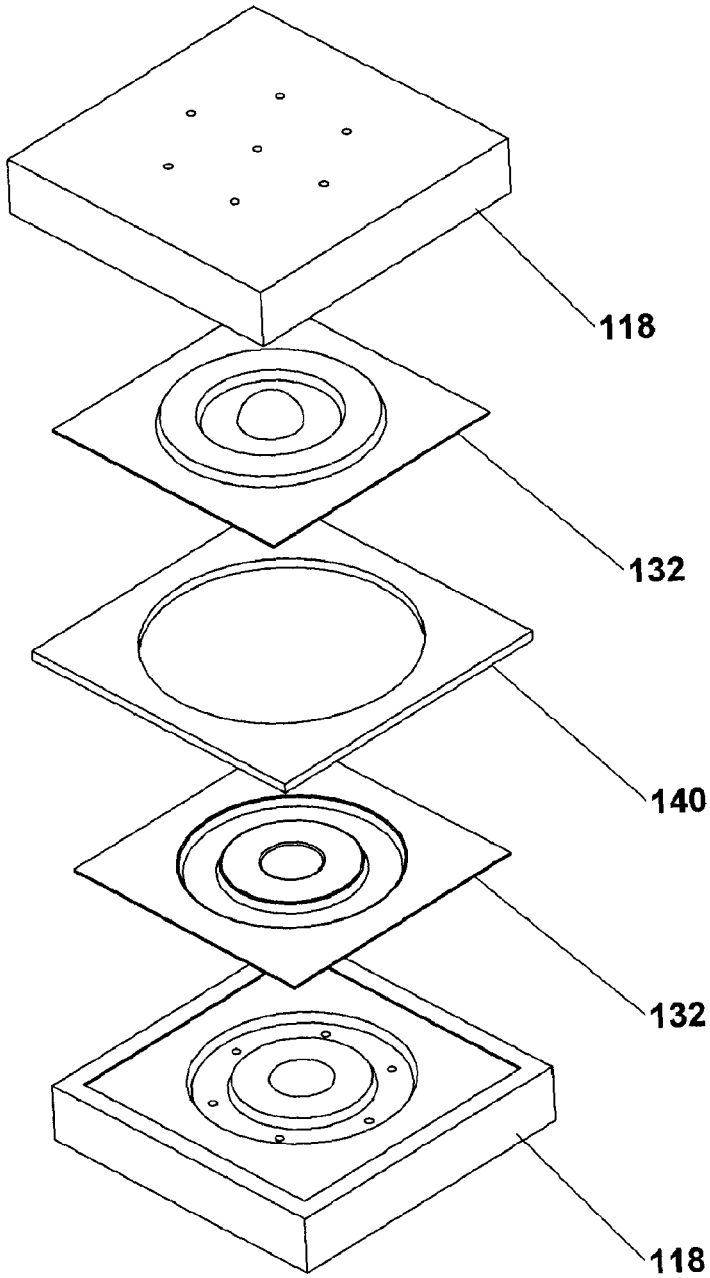
FIG. 18 is a perspective exploded view of an embodiment of the invention illustrating one example of the use of two dies and resulting hydroformed sheet parts used in hydroforming two sheets simultaneously.

FIG. 18 illustrates a further embodiment of this invention as applied to the simultaneous forming of two sheets. In this example, two workpieces 132, substantially submerged within fluid 14 described above, are formed in a two-sided configuration, wherein two workpieces 132 are formed from sheet blanks 128 (not shown) placed between two forming dies 118 having the desired cavity shape of the final desired product. To produce the products, a volume of high pressure fluid 14 is introduced into an interstitial space existing between the two positioned sheet blanks 128 to respectively and simultaneously deform the workpieces 132 against its respective die 118. The interstitial space may be introduced by means of a spacer 140 positioned between the sheet blanks 128 or by other means. Similar to tube hydroforming, venting of fluid captured between the die 118 and the expanding workpiece 132 is accomplished via die vent ports 120 as described above and shown by example in FIG. 17. Again, the benefits as heretofore described apply to this embodiment of this invention as well.

The present invention, then, will be understood as providing several advantages over methods and devices of the prior art, at least in the exemplary embodiments disclosed herein. Unlike hydroforming methods that only employ a fluid on one side of a part during forming as a pressurizing medium (e.g. inside a tube), this invention employs a temperature controlled fluid medium on each surface of the workpiece, which allows preheating (or precooling, in the event where that is desired) through intimate contact on all surfaces, promoting a uniform part temperature distribution.

When the contacting fluid contains a lubricating agent, the contact of the workpiece with the fluid reduces friction between the contacting surfaces of the die and workpiece promoting the forming operation. Pre-lubrication of the workpiece is consequently eliminated.

As described previously, another advantage is realized when a tubular workpiece is moved into the die already filled with the hydroforming fluid thereby eliminating the need to sequentially fill each blank workpiece before the forming process, which reduces the time in the die for the workpiece and increases potential production rate over previous methods and devices. Similarly, removing the hydroformed product from the die while still filled with the hydroforming fluid decreases the time in the die, by eliminating workpiece drain time while the workpiece resides in the die. Furthermore, since the workpiece is immersed in the fluid, the fluid is instantly recaptured within the chamber upon workpiece removal from the die thereby eliminating the need for external drainage and recirculation systems for reintroduction of the fluid to the workpiece. Since the workpiece is also pre-filled by immersion within the fluid, only a fluid volume change required to form the workpiece is needed, which typically is a significantly smaller percentage of the total fluid volume needed to both fill and form the workpiece and advantageously reduces the time needed to form the workpiece.

Pre-heating (or pre-cooling, if desired) of the workpiece in the fluid bath before and during the forming operation further reduces process cycle-time and increases the production rate, which is yet another advantage of present invention.

Because the dies can be immersed in the temperature-controlled fluid, the requirement to provide heating to the dies to maintain their temperature may be significantly reduced or eliminated.

When the same fluid is used for pre-heating the workpiece, maintaining die temperature, and performing the hydroforming of the workpiece, the fluid is more easily managed than in previously known hydroforming systems.

The inherent movement of the workpieces and the dies within the controlled-temperature bath, as well as the pumping of fluid into the workpiece in the die and draining of the fluid from the formed product during workpiece removal agitates the bath, reducing the need for circulating pumps to maintain an even temperature distribution within the bath. Furthermore, means for maintaining a substantially uniform temperature distribution within the fluid and, consequently a workpiece, may comprise fluid agitation as described above, or by ancillary agitation or fluid circulation means.

It should be further noted that the invention may be practiced at temperatures at or different from ambient realizing many of the advantages herein described.

While certain embodiments of the present invention are described in detail above, the scope of the invention is not to be considered limited by such disclosure, and modifications are possible without departing from the spirit of the invention as evidenced by the following claims.

What is claimed is:

1. An apparatus for hydroforming a workpiece into a product, the apparatus comprising:

a chamber adapted for containing a quantity of an incompressible fluid;

a means for maintaining the fluid at a controlled temperature, and a means for hydroforming the workpiece, the means situated in said chamber such that said workpiece is substantially immersed in said incompressible fluid during the hydroforming operation thereupon.

2. The apparatus of claim 1, wherein:

said workpiece is a tube having open ends; and said hydroforming means comprises first and second dies.

3. The apparatus of claim 2, wherein:

the hydroforming means comprises:

a means for sealing the open tube ends;

a means for injecting and pressurizing a fluid suitable for hydroforming into a cavity in the tube, said injecting and pressurizing means communicated to said sealing means; and a means for venting the incompressible fluid between the tube and the dies as the tube expands against the dies.

4. The apparatus of claim 1, wherein:

said workpiece is a sheet; and said hydroforming means comprises a first die.

5. The apparatus of claim 4, wherein:

the hydroforming means comprises:

a means for sealing a periphery of said sheet in said hydroforming means with a first side of said sheet facing said first die;

a means for injecting and pressurizing a fluid suitable for hydroforming into a sealed cavity on said second side of said sheet; and a means for venting the incompressible fluid between the first side and the die as the sheet expands against the die.

6. The apparatus of claim 1, wherein:

said workpiece comprises a pair of sheets; and said hydroforming means comprises a first and a second die, with said pair of sheets registrable between said dies.

7. The apparatus of claim 6, wherein:

the hydroforming means comprises:

a means for sealing a periphery of said sheets in said hydroforming means with a first side of said first sheet facing said first die; and a first side of said second sheet facing said second die;

a means for injecting and pressurizing a fluid suitable for hydroforming into a sealed cavity between said second sides of said sheets; and a means for venting the incompressible fluid between the respective first sides and the die as the sheet expands against the die.

8. The apparatus of claim 1, wherein:

said chamber is closed to the atmosphere, at least during said hydroforming operation.

9. The apparatus of claim 8, further comprising:

means for blanketing said fluid with an inert gas within said chamber to isolate said fluid from the atmosphere.

10. The apparatus of claim 1, wherein:

said controlled temperature differs from ambient by more than 20 degrees Fahrenheit.

11. The apparatus of claim 1, further comprising:

a means for raising or lowering said fluid level in said chamber in association with engagement or disengagement of said hydroforming means with said workpiece.

12. The apparatus of claim 1, further comprising:

a portion of said chamber for immersion of at least one said workpiece in said fluid prior to hydroforming; and means for transferring each said workpiece into said hydroforming means.

13. A method for hydroforming a workpiece into a product, comprising the steps of:

immersing the workpiece in a bath of an incompressible fluid maintained at a controlled temperature, the bath also having a die with a cavity positioned therein;

moving said workpiece into the cavity;

closing said die upon said workpiece and maintaining a pressure thereupon;

expanding said workpiece plastically in said die to fill said cavity by injecting a pressurized incompressible fluid into an interior thereof, thereby forming said product; and opening said die and removing said product therefrom.

14. The method of claim 13, wherein:

the step of closing the die further comprises the step of raising a level of said fluid bath to immerse said workpiece in the fluid; and the step of opening said die further comprises the step of lowering a level of said fluid bath to expose the product.

15. The method of claim 13, further comprising the steps of:

closing a chamber containing said bath prior to moving said workpiece into said cavity; and opening said chamber after removing the product from said die.

16. The method of claim 13, wherein:

said pressurized injected fluid comprises a portion of said incompressible fluid in said bath.

17. The method of claim 13, wherein said fluid comprises a lubricant that promotes the hydroforming of said workpiece.

18. An apparatus for hydroforming a pair of sheets into a product, the apparatus comprising:

a chamber adapted for containing a quantity of an incompressible fluid;

a means for hydroforming the pair of sheets, the hydroforming means comprising:

a first and a second die situated in the chamber, each sheet registrable between the dies with each sheet substantially immersed in the incompressible fluid during the hydroforming operation thereupon;

a means for sealing a periphery of each sheet in the hydroforming means with a first side of the first sheet facing the first die; and a first side of the second sheet facing the second die;

a means for injecting and pressurizing a fluid suitable for hydroforming into a sealed cavity between the second sides of the sheets; and a means for venting the incompressible fluid between each first side and the respective die as the each sheet expands against the respective die.

19. The apparatus of claim 18, wherein:

the chamber is closed to the atmosphere, at least during said hydroforming operation.

20. The apparatus of claim 19, further comprising:

a means for blanketing the fluid with an inert gas within the chamber to isolate the fluid from the atmosphere.

21. The apparatus of claim 18, further comprising:

a means for raising or lowering the fluid level in the chamber in association with engagement or disengagement of the hydroforming means with the pair of sheets.

22. The apparatus of claim 18, further comprising:

a portion of the chamber for immersing the sheets in the fluid prior to hydroforming; and a means for transferring the sheets into the hydroforming means.

23. The method of claim 15, further comprising the step of:

blanketing said fluid with an inert gas within said chamber to isolate said fluid from the atmosphere.

* * * * *